United States Patent [19]

Taffer

[11] 4,333,367

[45] Jun. 8, 1982

[54] FEED CONTROL SYSTEM FOR AUTOMATIC FASTENER DRIVERS

[76] Inventor: Brenda W. Taffer, P.O. Box 335, Conover, N.C. 28613

[21] Appl. No.: 162,170

[22] Filed: Jun. 23, 1980

[51] Int. Cl.[3] ..... B25B 23/04

[52] U.S. Cl. ..... 81/430

[58] Field of Search ..... 81/57.37, 454, 430; 227/112

[56] References Cited

U.S. PATENT DOCUMENTS

| | | | |
|---|---|---|---|
| 2,870,805 | 1/1959 | Zakrzewski et al. | 81/430 |
| 3,946,926 | 3/1976 | Willis | 227/112 |
| 3,958,614 | 5/1976 | Bandera | 81/430 |

*Primary Examiner*—James L. Jones, Jr.

*Attorney, Agent, or Firm*—Charles R. Rhodes; Judith G. Smith

[57] ABSTRACT

A pair of microswitches are mounted in the housing of an automatic screwdriver in the path of relative movement of the barrel thereof as it is urged rearwardly to activate a throttle valve and thus operate the drive mechanism of the screwdriver. Closure of both microswitches, which occurs during the driving of a fastener, resets the entire control circuit in readiness for the automatic emplacement of a new fastener upon completion of one driving operation. Release of one of the microswitches, as when the driving is completed activates a timer and air cylinder to drive the barrel forward into an extended receiving position. At the receiving position a new fastener is emplaced in the chamber of the mechanism. On completion of a predetermined time cycle, the barrel is returned to its normal position with one microswitch engaged, one not engaged, and a fastener in the barrel against the kit ready for the driving operation. Thus, a new fastener is automatically delivered to the chamber responsive to the completion of the driving of the previous fastener. Further the screw in the chamber cannot be inadvertently removed therefrom except by the driving operation.

9 Claims, 5 Drawing Figures

FEED CONTROL SYSTEM FOR AUTOMATIC FASTENER DRIVERS

BACKGROUND AND SUMMARY OF THE PRESENT INVENTION

Air driven tools such as hammers, riveters, or screwdrivers have been known for a long period of time. In such type of equipment, air under pressure is delivered to a turbine or air motor. The force of the air causes the motor, in the case of screwdrivers, to turn. This turning motion of the air motor may be coupled to the bit of the screwdriver to mechanically turn the bit and thus the screw or fastener which is held thereby. Various devices for selectively introducing the air to the motor are well known in the art. One such device is the throttle valve, which includes a valve body normally covering an air inlet. This valve body is released from the air inlet responsive to operator pressure against the rear of the housing of the mechanism, as when the screw is positioned at the point at which it is to be driven and force is exerted against it. Air is then forced into the air motor, causing it to turn, thereby transmitting a rotary force to the bit for purposes of driving the screw.

Screws are emplaced in the receiving chamber of the barrel in various ways. At the very outset, of course, each screw was manually positioned in the end of the barrel by hand. Various devices have been developed more recently for mechanically delivering screws into the barrel from a hopper. An example of one such prior device is set forth in applicant's prior U.S. Pat. No. 3,946,926.

Further examples of fastener feed controls for air driven screwdrivers are set forth in U.S. Pat. Nos. 3,958,614 to Bandera and 2,870,805 to Zakrzewski et al. Both of these patents are directed to mechanical devices for fastener feeding which will prevent double feeding of fasteners.

Reliable and safe fastener feeding is the object of the present invention and is believed to be the way in which the present invention departs from the prior art. The control device according to the present invention utilizes electronic circuitry to automatically effect the feeding of one and only one fastener at a time into the receiving chamber of the tool. Operation of the drive mechanism in the normal fashion only, i.e. pressure against the housing to open and close the throttle valve resets the feed circuit. Release of pressure against the housing electronically sets in motion all of the succeeding operations which are necessary to reliably feed a new fastener and return the apparatus to the ready position with a new fastener in the chamber. There is no need for any foot pedal or other safety devices which have to be activated by the feet or one of the hands. All of the safety features and the reliability measures are activated solely by the movement of the barrel rearwardly and forwardly.

In order to effect such improved fastener feeding technique, there has been built into the driving apparatus a unique electronic switching apparatus which acts responsive to movement of the barrel back and forth between the two positions which are necessary to supply air through the throttle valve into the air motor of the device. Toward this end, as the housing of the fastener driving apparatus is moved forwardly with respect to the barrel thereof (normal operation) to open the throttle valve and supply air to the air motor, an electrical switching element is engaged which resets the entire electronic circuit electronically setting everything in readiness for the ensuing fastener feeding operation. Then, as the housing moves rearwardly (responsive to release of pressure against the housing), the air supply to drive the motor is cut off and the switching element is disengaged creating an electrical signal through the control circuit.

This signal accomplishes two results in the preferred embodiment. First of all, it activates an air cylinder to blow the housing rearwardly (or the barrel forwardly) to the fastener receiving position in line with the fastener supply conduit. Secondly, a timer is activated, which upon completion of the fastener feeding will return the barrel to the normal position.

Some mention should be made here to the term "fastener receiving position". In the normal operation of air driven screwdrivers, a fastener is fed into a receiving chamber. The drive bit is then urged into engagement with the fastener slot as the operation commences. Thus when a fastener is fed, the bit is initially spaced therefrom and the fastener is loosely held by "dogs". In a preferred embodiment of the present invention the barrel is driven forward to receive a fastener, then returned to a normal or ready position with the fastener in position against and partially stabilized by the screwdriver bit. Toward this end a unique air cylinder is built into the barrel and housing to urge the barrel toward the extended position.

In general, the present invention includes a housing which carries a throttle valve, and an air motor mounted therein, and a barrel reciprocally connected thereto. The barrel is slidably received within the housing for movement between a normal, ready position, a driving position with the barrel moved rearwardly with respect to the housing; and an extended fastener receiving position in which fasteners are delivered into the receiving chamber thereof. A switching means is mounted in the housing in the path of movement of the barrel for detecting the barrel position and for causing a changed electrical condition responsive to movement of the barrel to any one of those positions. The electrical control circuit which is operated responsive to the switching means automatically effects delivery of a new fastener to the chamber responsive to the completion of the driving of the preceding fastener and unlocks the circuit for a new driving operation after a predetermined time delay.

In order to ensure that only one fastener is driven at a time, the electronic circuit must be reset by movement of the barrel to the driving position before the feeding of another fastener can occur. Then the feeding operation cannot commence until a fastener is driven and the barrel returned to the normal position.

Therefore, without any auxiliary equipment to be activated by the operator, there is provided a reliable, improved and unique fastener control system which ensures that one and only one fastener is fed into the receiving chamber of an automatic screwdriver. Further, the control apparatus with its electrical circuit ensures that a fastener cannot be fed into the receiving chamber of the barrel until the previous screw has been completely driven and is out of the tool. Fasteners are securely seated on and supported by the bit of the screwdriver prior to commencement of the driving operation.

A more complete understanding of the invention will become apparent from reading the following detailed description of a preferred embodiment along with the accompanying drawings in which:

FIG. 1 is a perspective view, with parts broken away for the sake of clarity illustrating the overall screwdriving apparatus and setting forth the environment in which the present invention is utilized;

FIGS. *2a–2c* are sectional, schematic views, illustrating the relation of the barrel to the microswitches, the housing, and the drive bit at three stages of the operational sequence, as well as schematically representing the air cylinder formed between the barrel and the housing wall; and FIG. 3 is an electrical schematic view setting forth the control circuit of the present invention.

DETAILED DESCRIPTION OF A PREFERRED EMBODIMENT

Figure 1:
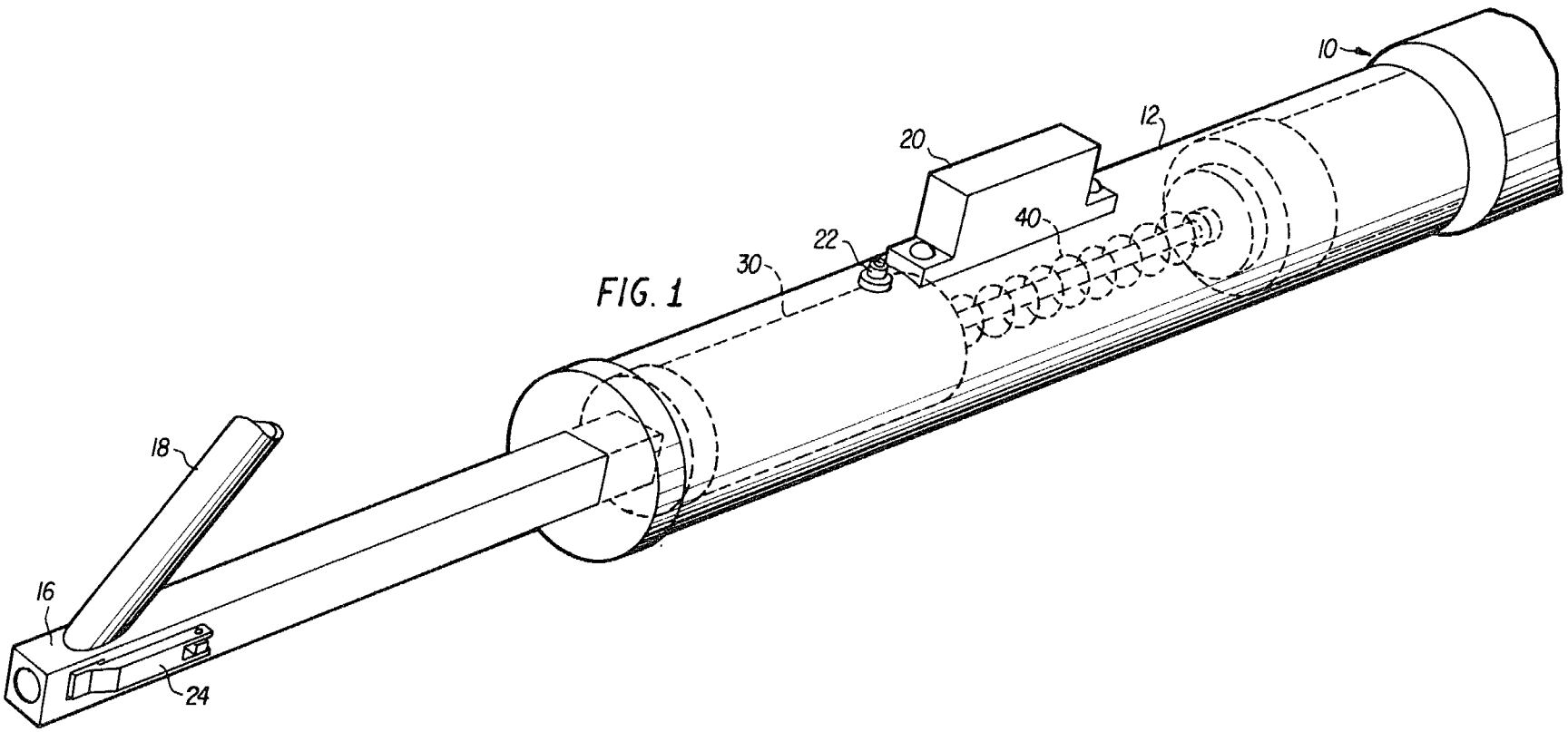
Figure 2A:
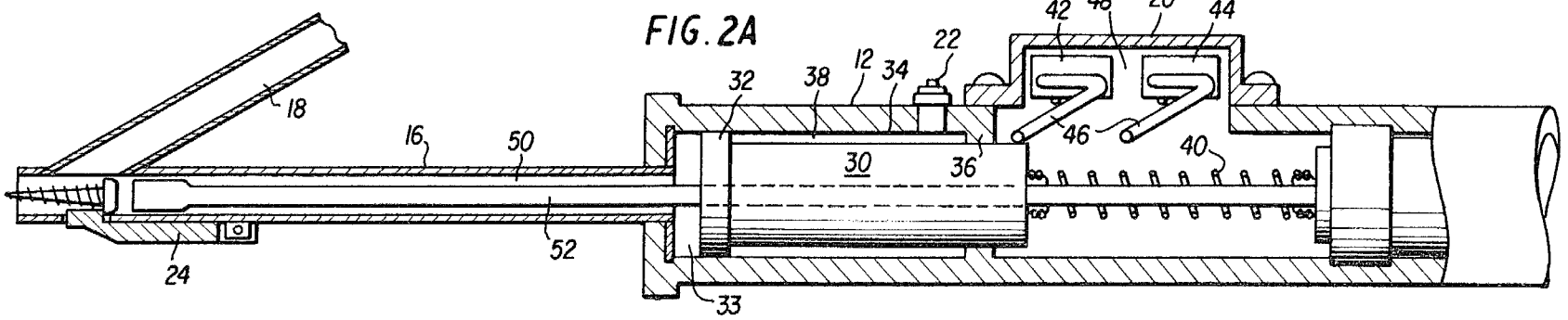
Figure 2B:
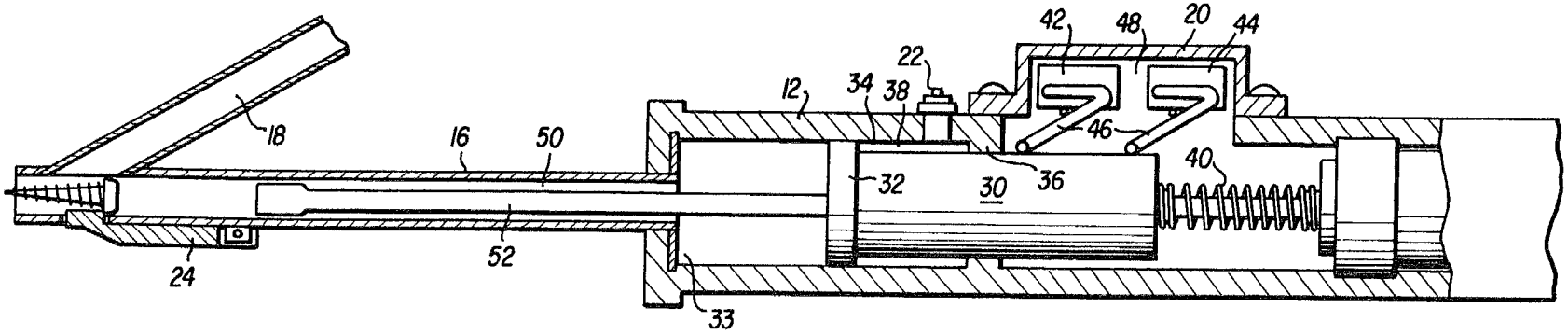
Figure 2C:
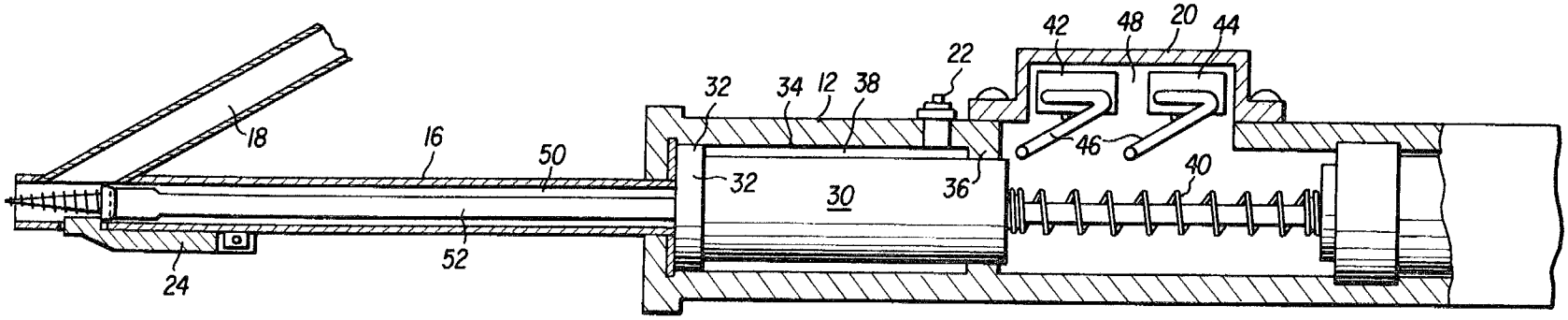

Turning now to FIG. 1 there is illustrated the automatic fastener driving machine of the type according to the present invention. The screwdriver includes a first housing portion 10 which encloses the air motor and throttle valve of the unit. As the air motor or throttle valve is conventional, and its operation well known, it is not believed necessary for a detailed explanation of the manner in which the air motor operates and is activated.

Continuing with the description of the exterior portion of the unit, the front housing portion 12 encloses the barrel and control portion of the unit. A source of air under pressure (not shown) is provided to the housing portion 10 for operation of the air motor in a well known manner. A barrel 16 has an interior portion which is supported within housing 12 for reciprocal movement therein and an exterior portion extending forwardly therefrom. A fastener conduit 18 extends down into communication with the front end of barrel 16 for delivery of fasteners thereto. Dogs 24 provide gripping relation, as well as some support for the screw as it is lined up and introduced to the bit of the screwdriver.

A switch housing 20 is secured to the side of barrel portion 12 for supporting a pair of microswitches in communication with the path of barrel 16 therein as will be described hereinafter. An air valve 22 provides a second inlet for compressed air to the screwdriver through the wall of housing 12 for driving the barrel 16 forwardly as will be described hereinafter.

Turning now to FIGS. *2a–2c*, there is schematically illustrated the control mechanism in a manner which will make the present invention more understandable. First of all, barrel 16 includes an enlarged portion 30 within the housing 12. The front end of barrel portion 30 includes an enlarged annular portion 32. Housing 12 includes a front chamber which is formed by a cylindrical inner wall 34 and a projection 36 extending radially inwardly therefrom. The inner surface of projection 36 engages the barrel portion 30 in airtight, sliding relation, as does the outer surface of the enlarged portion 32 engage the cylindrical wall of barrel 12. Suitable seals and/or gaskets for such airtight chambers are well known and thus will not be described here. An air chamber 38 is formed between the inner wall of barrel 12, the outer surface of barrel portion 30, projection 36 and enlarged portion 32. The aforementioned second air inlet 22 communicates with this air chamber, so that as air is introduced to chamber 38, the barrel 16 is caused to slide forwardly.

The rear of inner portion 30 of barrel 16 is connected by a coil spring 40 to the stationary air motor in rear housing 10 and normally biased to an intermediate position. A pair of microswitches 42,44 are supported within switch housing 20 and have the activating arms 46 thereof extending through an opening 48 in the wall of housing 12. So mounted, the activating arms 46 of switches 42,44 are in the path of barrel portion 30 as it reciprocates within housing 12 in a manner to be described hereinbelow. The two microswitches 42,44 are thus able to detect three barrel positions, each of which will create a different electrical mode.

Barrel 16 includes a passageway 50 running through the entire length thereof through which the drive bit 52 extends. Drive bit 52 passes rearwardly through the passageway 50, out the rear end of barrel portion 30 and into engagement with the air motor mechanism in a conventional fashion. The coil spring 40 surrounds the bit 52, however, does not impede its relative movement therein at all. A sealing washer 33 is attached to the front end of barrel portion 30 to ensure a good seal within air chamber 38.

Mechanical operation of the device is as follows. The barrel, during operation of the screwdriver reciprocates between the three positions illustrated in FIGS. *2a*, *2b*, and *2c*. In FIG. *2a*, which is the normal position, the interior barrel portion 30 is so situated within the housing 12 that the barrel depresses the lever 46 of the first microswitch 42, however, is not in engagement with the second microswitch 44. In this position, a fastener F is held by dogs 24 (FIG. 1) back in engagement with the bit 52, ready for driving upon activation of the screwdriver. The air is evacuated from chamber 38 and the coil spring 40 is at rest and not under tension or compression.

To activate the driving operation, pressure is exerted against the rear of housing 10 by the operator, which moves barrel 16,30 rearwardly with respect to housing portion 12 and bit 52 to the position shown in FIG. *2b*. It should be kept in mind that the barrel 16 is in slidable engagement with housing 12 and movable with respect thereto, while the bit 52 is longitudinally stationary with respect to the housing 10,12 and subjected only to the rotary force of the air motor (not shown). During this time a bleed valve (not shown) allows air to bleed from chamber 38 so as not to build up pressure therein. The aforementioned movement of housing 12 causes the enlarged barrel portion 30 to move relatively rearwardly with respect to the microswitch 44 until the lever 46 thereof is also depressed. As will be explained hereinbelow this resets the entire feeding sequence to follow. Once the screw is driven, and pressure released from housing 10, coil spring 40 returns the barrel portion 30 to its normal position between the levers 46 of mircroswitches 42,44 with microswitch 44 being deactivated.

The aforementioned movement activates the entire feeding sequence which is commenced by air being introduced through the second inlet 22 into chamber 38. This causes the barrel portion 30, which acts as an air cylinder, to be shoved forward to the position shown in FIG. *2c*. The aforesaid movement of barrel 30 causes the front barrel portion 16 to move forward relative to the bit 52 to a position where a new screw may be received in the chamber without interference from the bit 52. At the same time the release of barrel 30 from microswitch 42 causes a new fastener to be fed through conduit 18 into the front end of barrel 16. After a predetermined time interval the barrel is returned to the position shown in FIG. *2a* with the screw fastener firmly back in engagement with the bit and ready to commence a new driving operation.

Figure 3:
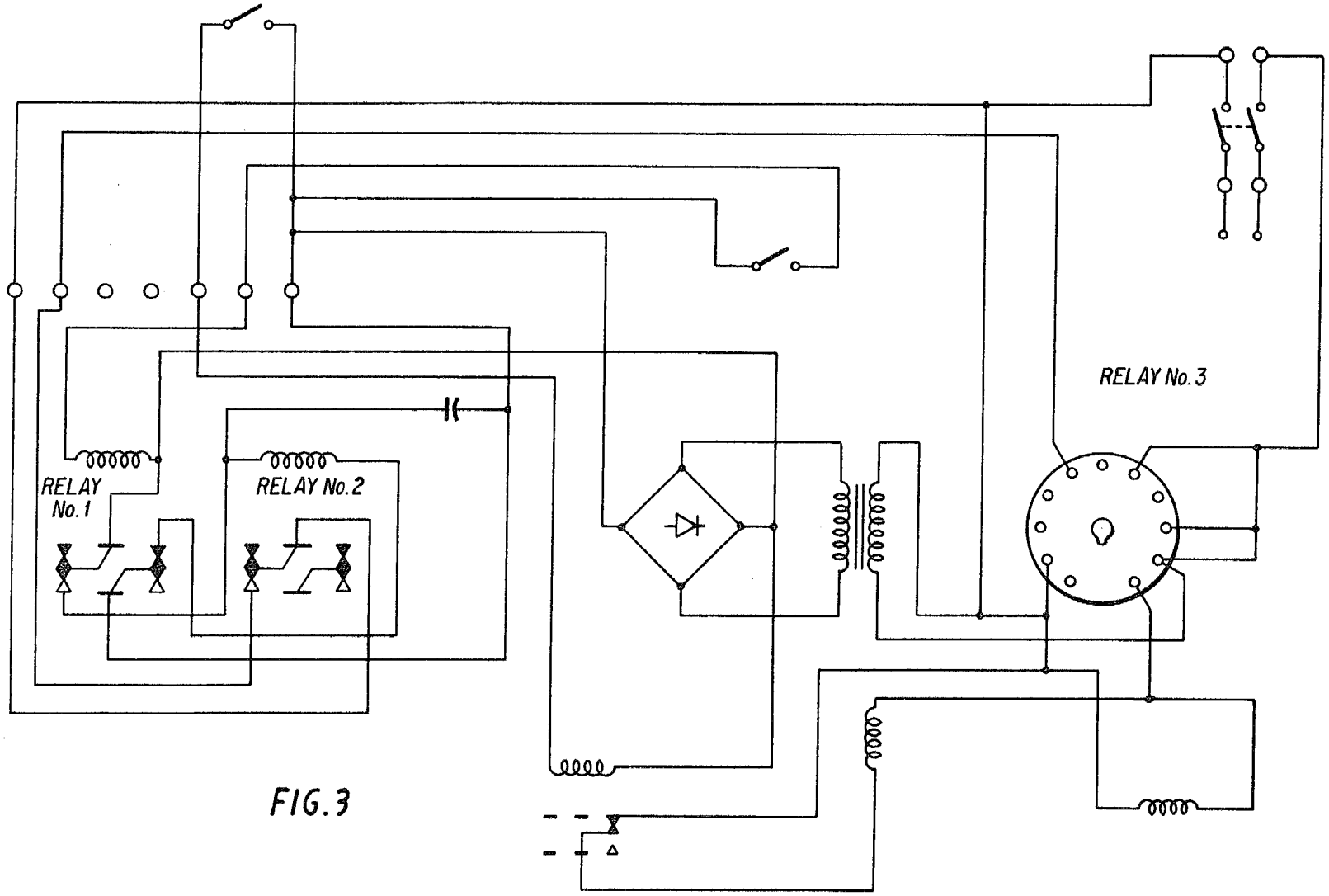

The electrical schematic is illustrated in FIG. 3. For the most part relays and timing devices are utilized which would be a matter of ordinary skill to the skilled electronics artisan, once the operating sequence was known. Therefore, it is believed that a detailed description of the electrical circuitry is not necessary. However, in general, a first relay charges a capacitor to set up the entire system. When that first relay drops out the capacitor discharges while operating relay 2, the capacitor having only enough power to open relay 2 momentarily. The opening of relay 2 triggers a time delay sequence through terminals 5–7. Simultaneously terminals 11 and 9 close to complete the circuit which operates the coils for the air valve described hereinabove. The air cylinder therefore automatically operates when the time delay operates. The feed will not operate until the microswitch 42 is in the open position (as when barrel 16 moves out far enough to disengage the lever 46 of microswitch 42). At this same time relay 3 closes causing the feeding of a new fastener. The air cylinder remains activated until the time delay drops out, at which time the barrel slides back to hold the screw rigid and ready to be driven.

While one preferred embodiment has been described in detail hereinabove, it is apparent that various changes and modifications might be made without departing from the scope and intent of the present invention which are set forth by the claims hereinbelow.

What is claimed is:

1. A feed control apparatus for pneumatic fastener driving machines of the type in which a housing supports an air motor and a movable barrel which supports the fastener until driven by the motor through a drive bit, and in which a throttle valve is activated responsive to relative movement of the barrel with respect to the air motor to introduce air under pressure through a first input to the air motor or drive mechanism, and fasteners from a feed mechanism are pneumatically delivered to a receiving chamber in the barrel at the end of each driving operation; said feed control apparatus comprising:

(a) said housing carrying said throttle valve, air motor and barrel, said barrel including said receiving chamber therein and slidably received within said housing between three distinct positions, a ready position in which the fastener is seated with respect to said drive bit and engaged thereby, a driving position in which said barrel is moved rearwardly from said first position, and a fastener receiving position in which said barrel is urged forwardly of said first position to provide clearance for the entry of a new fastener;

(b) an electrical switching means mounted in said housing in the path of movement of said barrel and engaged thereby for detecting the barrel position at any one of said distinct positions and for causing a changed electrical condition responsive to movement of said barrel to any one of said three positions;

(c) an electrical control circuit connecting said drive mechanism and said feed mechanism, said circuit including said switching means for automatically initiating movement of said barrel to said third position and delivery of a new fastener from said feed mechanism to the chamber responsive to the movement of said barrel from said drive position back to said ready position.

2. The feed control apparatus according to claim 1 wherein said switching means includes a pair of microswitches each of said switches having an activating lever in the barrel path, whereby said three positions are detected by three microswitch modes, one in which both switches are closed, one in which both switches are open, and one in which one switch is open and one closed.

3. The feed control apparatus according to claim 1 wherein:

(a) said three distinct barrel positions include a first, rearmost, driving position; a second, intermediate, ready position; and a third, forward fastener receiving position;

(b) said barrel being normally spring biased to said intermediate position in which said barrel engages the activating arms of one, and only one, of said switches;

(c) said barrel being manually moved to said first position by operator pressure against said housing to activate said throttle valve, said barrel engaging the activating arms of both switches in said first position;

(d) pneumatic means for urging said barrel past said second position to said third position responsive to release of pressure against said housing, said barrel engaging neither of said activating arms of said microswitches in said third position.

4. The feed control apparatus according to claim 3 wherein said pneumatic means is an air cylinder activated responsive to movement of said barrel from said first to said second position.

5. The feed control apparatus according to claim 4 wherein said air cylinder comprises a shoulder extending radially outwardly from said barrel; a second shoulder extending radially inwardly from said housing; the inner wall of said housing, the outer of said barrel, and said first and second shoulders forming an air chamber; and a second air input extending through the wall of said housing into communication with said air chamber, whereby the introduction of air through said second air input urges the barrel outwardly to said third position.

6. A control apparatus for pneumatically driven, pneumatically fed automatic fastener driving machines of the type in which a throttle valve delivers air through a first input to the air driven motor of the machine to cause rotation of a drive bit and air from a second input delivers a new fastener into a fastener receiving chamber of the driving machine; said apparatus comprising:

(a) a housing and a barrel mounted for longitudinal movement therein;

(b) a switching means mounted on the side of said housing in the path of movement of said barrel for detecting the position of said barrel and indicating an electrical mode responsive thereto;

(c) an electrical control circuit including said switching means as a component thereof for effecting and accomplishing the installation of a new screw in the chamber responsive to the completion of the driving operation;

(d) said barrel during operation of the machine being movable between three different positions, such positions being a first, rearmost, driving position; a second, intermediate, ready position; and a third, forwardmost, feed position;

(e) said throttle valve operated responsive to said barrel being moved to said first position;

(f) air cylinder means for moving said barrel to said third position activated responsive to the barrel moving from said first position to said second position; and (g) a timing means also activated by movement of said barrel from said first position to said second position for deactivating said air cylinder to return said barrel to said second position after a predetermined time interval has expired.

7. A screwdriving apparatus comprising:

(a) a feed mechanism;

(b) a drive mechanism including;

(i) a housing carrying a drive motor, a drive bit connected to and operated by said drive motor, and a barrel;

(ii) said barrel surrounding said drive bit and being slidably mounted in said housing for longitudinal movement with respect to the longitudinal axis of said drive bit; said barrel further including a receiving chamber adjacent one end thereof for holding a fastener in position for driving by said drive bit, said receiving chamber being connected to said feed mechanism by a fastener conduit;

(c) control means for urging said barrel to an extended position with the receiving chamber spaced from said drive bit immediately prior to the delivery of a fastener, then returning said barrel to the normal position with the fastener head in engagement with said drive bit immediately after the delivery of a fastener.

8. The apparatus according to claim 7 wherein said control means includes an air cylinder connected to said barrel for moving said barrel from said normal position to said extended position.

9. The apparatus according to claim 8 wherein said air cylinder comprises a shoulder extending radially outwardly from said barrel; a second shoulder extending radially inwardly from said housing; the inner wall of said housing, the outer of said barrel, and said first and second shoulders forming an air chamber; and an air input extending through the wall of said housing into communication with said air chamber, whereby the introduction of air through said air input urges the barrel outwardly to said extended position.

* * * * *